US007219593B2

(12) United States Patent
Busani

(10) Patent No.: US 7,219,593 B2
(45) Date of Patent: May 22, 2007

(54) SATURATION-PROOF HYDRAULIC CONTROL DEVICE THAT IS COMPOSED OF TWO OR MORE ELEMENTS

(75) Inventor: Ulderico Busani, Reggio Emilia (IT)

(73) Assignee: Walvoil S.p.A., Reggio Emilia (IT)

( * ) Notice: Subject to any disclaimer, the term of this patent is extended or adjusted under 35 U.S.C. 154(b) by 0 days.

(21) Appl. No.: 11/156,702

(22) Filed: Jun. 21, 2005

(65) Prior Publication Data

US 2005/0287017 A1 Dec. 29, 2005

(30) Foreign Application Priority Data

Jun. 24, 2004 (EP) ..... 04014821

(51) Int. Cl.
*F15B 11/16* (2006.01)
*E02F 9/22* (2006.01)

(52) U.S. Cl. ..... 91/446; 91/518

(58) Field of Classification Search ..... 91/446, 91/518

See application file for complete search history.

(56) References Cited

U.S. PATENT DOCUMENTS 3,976,097 A * 8/1976 Brakel ..... 91/446
4,719,753 A 1/1988 Kropp
4,986,071 A 1/1991 Voss et al.
5,715,865 A 2/1998 Wilke
5,806,312 A 9/1998 Kauss
5,890,362 A 4/1999 Wilke
6,895,852 B2 * 5/2005 Pieper ..... 91/516
2003/0121256 A1 7/2003 Mather

FOREIGN PATENT DOCUMENTS

WO WO 98/13604 4/1998

* cited by examiner

*Primary Examiner*—Thomas E. Lazo
(74) *Attorney, Agent, or Firm*—Young & Thompson

(57) ABSTRACT

The invention refers to the field of hydraulic control devices and refers to a saturation-proof hydraulic control device with two or more elements; each element is composed of a six-way, two-position spool (4) of the proportional type, a pressure compensator (3), also of the proportional type, notches on the spool for a correct operation and pressure selector members (MS) equipped with spring (M7) that connect the various elements so that the work function at higher pressure sends the pressure to the spring side of its own pressure compensator (3), making it operate as check valve, and sending the pressure existing between spool (4) and pressure compensator (3) to the spring side of the compensators (3) of the other elements and to the pump (P). The spring (M7) must generate a minimum load that is slightly greater than the pressure drop of the maximum flow-rate through the local pressure compensator (3).

9 Claims, 6 Drawing Sheets

SATURATION-PROOF HYDRAULIC CONTROL DEVICE THAT IS COMPOSED OF TWO OR MORE ELEMENTS

The present invention refers to a saturation-proof hydraulic control device that is composed of two or more elements.

Function of the hydraulic control devices is opening, closing or deflecting an oil flow through control signals that can be of the manual, pneumatic, hydraulic or electric type.

In general, they are composed of a hollow body in which a mobile element slides, this element being called drawer or spool that, depending on its assumed position, communicates the different circuit branches respectively with fluid delivery or return.

The hydraulic control device spool can accurately assume its positions, immediately providing as output the full flow-rate or completely shutting it off: in such case, these are hydraulic control devices with "on-off" output.

On the contrary, if the spool can have, in addition to extreme position, infinite intermediate positions (restrictor positions) so that it has the chance of obtaining varying flows, these are proportional hydraulic control devices.

In such case, the sliding element or spool automatically also performs the function of uncompensated flow-rate adjusting valve. In an uncompensated flow-rate adjusting valve, the flow-rate is affected by the input and output pressure changes.

In order for the above changes to be efficient on the flow-rates, it is necessary to use another component, called pressure compensator, which keeps the pressure drop $\Delta P$ constant and therefore unchanged on the hydraulic control device ports.

The insertion of a pressure compensator therefore makes the flow-rate univocally linked to the spool stroke and independent from the load.

Since the element outputs are two, the element itself with related spool is designed so that the only pressure compensator indifferently intervenes on both outputs (or work functions).

When mobile machines are dealt with, the use of many elements assembled one beside the other in order to form a single block called hydraulic control device is widely spread.

The operator, acting on the control lever, gradually moves the hydraulic control device spool and adjusts the spool opening. It stems that globally there is an increase of elements equal to the number of users to be interlocked.

In case the simultaneous actuation of many users requires a global flow-rate that is greater than the maximum pump flow-rate, the system gets "saturated".

In order to solve such inconvenience, it is necessary to adequately choose and arrange the compensators so that the flow-rate reduction on the users, with respect to the one defined by the spools stroke, is arranged in percentage among all working users.

Such arrangement, called saturation-proof, allows, if not keeping the desired speeds, keeping the relative movements among working users similar.

Hydraulic control devices arrangements that solve the majority of the above stated problems are already known in the art.

A first prior art example is disclosed in U.S. Pat. No. 4,719,753 in which one pressure compensator is provided for every work function, instead of one for every element, which is translated into the use of a double number of compensators with the same work functions.

Moreover, as can be read from U.S. Pat. No. 4,719,753 patent, the signal sent by the higher-pressure work function to all compensators and to the pump pressure compensator is taken downstream of the higher-pressure pressure compensator, directly from the higher-pressure work function. In order to avoid the load descent, this is not directly sent, but is copied (due to a four-way, two-position, non-on-off spool that is able to be continuously placed in intermediate positions) withdrawing oil upstream of the pressure compensator (between spool and pressure compensator).

Likewise to the previous patent, the circuit reported in the patent WO98/13604 withdraws the oil between the cursor and the pressure compensator reducing its pressure to the value of pressure downstream the pressure compensator.

In this case it doesn't happen by means of a selector spool but setting on the LS signal, physically taken upstream of compensator, a restrictor and a check valve that allows the signal flow only towards the conduit downstream compensator.

So, when the LS signal is greater than the pressure downstream of the compensator, this valve is open.

This generates a flow that prevents the LS pressure from becoming greater than the pressure downstream the pressure compensator.

This is possible thanks to the pressure drop through the restrictor.

It must be remembered that the stand-by useful to determine the flow-rate through the spool is given by the stand-by imposed by the pump minus the fixed pressure drops between pump and signal withdrawing point. Being this one taken downstream of the pressure compensator, its losses also impair the useful stand-by. At maximum flow-rates, it is easy to have a pressure drop of 1–2 bars that on a stand-by that can range from 10 to 20 bars can be 10–20%. Moreover, the work function pressure taken downstream of the pressure compensator on the element with higher pressure is set, by means of the pressure compensator in the lower-pressure element, upstream of the pressure compensator (between spool and pressure compensator). It follows that in the lower-pressure element, the useful stand-by is greater than that in the higher-pressure element. It then follows that a reversal of the higher-pressure element generates an increase of the useful stand-by on the one previously at a higher pressure and vice versa, to which a stepwise flow-rate increase corresponds, and vice versa.

Another example is disclosed in U.S. Pat. No. 5,715,865: therein, the pressure signal is taken before each pressure compensator and the highest pressure before the pressure compensators is sent, through a simple series of selecting devices, to the pump and all local compensators, including however also the one on the higher-pressure element.

It stems that this latter one has the same pressure on both sides: if the spring were inserted in the classical check valve position, the pressure compensator would plug the passage, but this latter one is placed exactly along the opposite direction. Being built in this way, however, the pressure compensator does not operate any more as check valve (due to the fact that it is normally open) from which the need arises to insert a check valve apart inside the pressure compensator to avoid load drop phenomena.

Moreover, as prior art example, U.S. Pat. No. 5,890,362 discloses the particular pressure compensator shape that here is divided in two in order to operate both as selector and as check valve.

Describing the technique adopted in U.S. Pat. No. 5,806,312, the use of the pressure compensator operating as selector is disclosed, from which it stems that only in the higher-pressure element the pressure compensator is so lifted as to open the internal hole towards the pressure compensator spring side, thereby taking the pressure, before the pressure compensator, to the other compensators and the pump. The lower-pressure elements instead are less lifted and never get to open such hole.

Since the pressure compensator, due to its function, has to open the passage between pump and work function before opening the signal hole, it is not able to prevent, in those transient in which the work function pressure exceeds the pump pressure, the load drop.

It is therefore necessary to insert, downstream of the pressure compensator, check valves adapted to prevent such phenomenon.

The same Applicant has realised a single-block saturation-proof hydraulic control device for front loaders: excluding the specific application, the saturation-proof concept remains, that however is inserted in a single-block hydraulic control device, specifically for two hydraulic cylinders.

This implies that, in said hydraulic control device, there are only two elements, this allowing a single spool that compares the pressure signals directly between the cylinders; the addition of a further user is prevented by the fact that only one spool deals with compensating pressures and saturation. Therefore, such patent is a limit for the number of users to be managed.

The extension to an hydraulic control device that is able to be composed, of the solutions used in single-blocks makes the system highly complex due to the difficulty of directly comparing a number N of work functions.

A prior art inconvenience is that the stated problems, namely load drop phenomena, flow-rate steps and saturation, are either not satisfactorily and completely reached, or are solved with proportional selector systems that point out a relevant constructive delicacy.

Object of the present invention is obtaining a saturation-proof hydraulic control device that is composed of many elements according to the number of work functions to be used, that allows compensating user pressures and system saturation-proof when the simultaneous actuation of many users requires a global flow-rate that is greater than the maximum pump flow-rate.

Among the advantages that can be obtained by the saturation-proof hydraulic control device that is composed of two or more elements, mention can be made of an object composed of a number of elements equal to the number of work functions to be interlocked that contain the same hydraulic diagram, providing the following results:

- Absence of load drop transients due to the fact that the oil that actuates the pump pressure compensator is taken upstream of the pressure compensator: this operating as check valve, and not from the work function;
- Increase of actual stand-by on spool, which means greater flow-rate with the same stand-by, namely lower stand-by with the same flow-rate, therefore lower energy losses. This because the stand-by imposed by the pump is between pump and work function after the spool before the pressure compensator;
- Absence of actual stand-by jumps and consequent flow-rate steps upon reverting the work function at a higher pressure due to the fact that the actual stand-by is equal for all spools, both the one with higher pressure and those with lower pressure;
- Suppression of the need to insert check valves in the circuit to avoid load drop phenomena: such function is performed by the pressure compensator during particular operating times.

These objects and advantages are all obtained by the saturation-proof hydraulic control device that is composed of two or more elements, object of the present invention, that is characterised by what is provided in the below-listed claims.

These and other characteristics will be better pointed out by the following description of some embodiments shown, merely as a non-limiting example, in the enclosed tables of drawing, in which.

Figure 1:
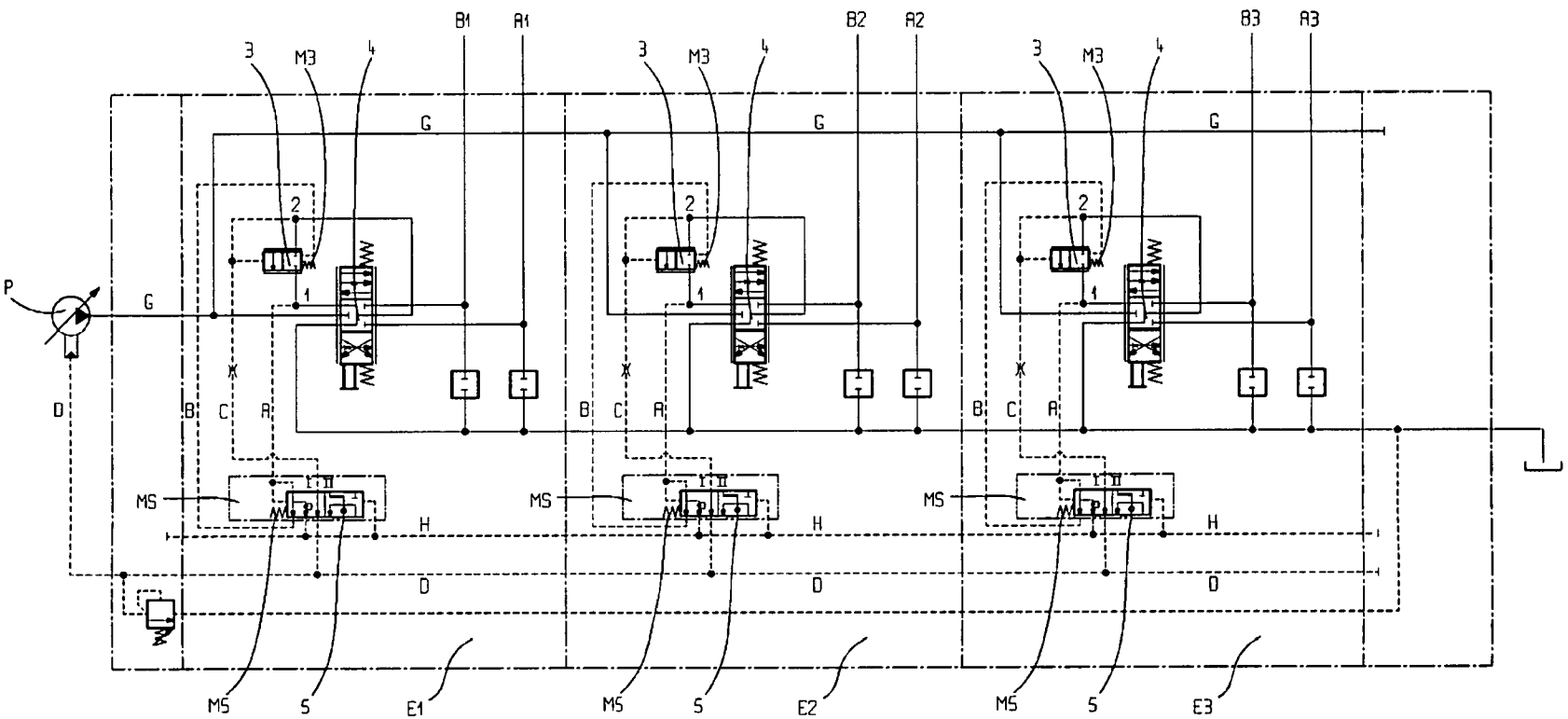
FIG. 1 shows a saturation-proof hydraulic control device that is composed of two or more elements with selector spool.

With reference to FIG. 1, P designates a hydraulically-driven variable-flow-rate pump driven through the pressurised oil coming from line D.

The hydraulic control device is specifically made of three elements E1, E2, E3, each one of which is connected with its respective users through connections A1–B1, A2–B2, A3–B3.

Every element is equipped with a six-way, three-position spool 4, a pressure compensator 3 and a selector means MS, specifically a selector spool 5, of the on-off, five-way, two-position type.

The pump P supplies, through a duct G, each spool 4.

Assuming to actuate the spool 4 of the element E1, the pressure of the respective work function, taken in spot 1, arrives on the spring M5 side, with a neglectable force, of the selector spool already initially in position I for the spring action itself. In such position, the selector spool connects spot 1 to channels B and H.

By means of channel B, the work function pressure arrives on the spring M3 side of the pressure compensator: therefore, in such element, it only operates as check valve.

Through channel H, it arrives to all selector spools 5 of elements E1, E2 and E3 on the opposite side of spring M5 of said selector spools 5.

In the actuated element E1, having the same pressure on both sides of the selector spool 5, this remains in position I for the spring action.

The other selector spools 5, having the spring side unloaded, move to position II.

In position I of the selector spool 5 of the actuated element E1, the pressure between spool 4 and pressure compensator 3, taken in spot 2, is connected to channel D that takes such pressure both to pump P and to the other selector spools 5.

Being these latter ones in position II, they connect the channel D, with pressure taken in 2, to the spring M3 side of the pressure compensator 3 that therefore actually functions as pressure compensator.

Assuming to actuate a second element E2, with work function at a lower pressure, this one, taken in spot 1, will arrive to the spring M5 side of its own selector spool, but being lower by hypothesis, it will not move it and the connections will remain unchanged.

If on the contrary we assume that said value is greater, then its own spool 5 will move to position I with the consequence of sending its own work function pressure to channel H and from here to operate on the other selector spools 5 on the opposite side of the spring M5: therefore, the selector spool 5 of the element E3 will remain in position I while the selector spool 5 of the element E1 will move to position II.

The end result is that only the higher-pressure element has the selector spool 5 in position I, sending its own pressure taken from spot 1 to its own pressure compensator 3, which functions as check valve, and sending the pressure between spool 4 and pressure compensator 3, taken in spot 2, to the other selector spools. These latter ones are in position II that allows a single connection, namely the one between channel D and spring M3 side of the pressure compensator 3 of each respective element where it actually operates as pressure compensator.

Figure 2:
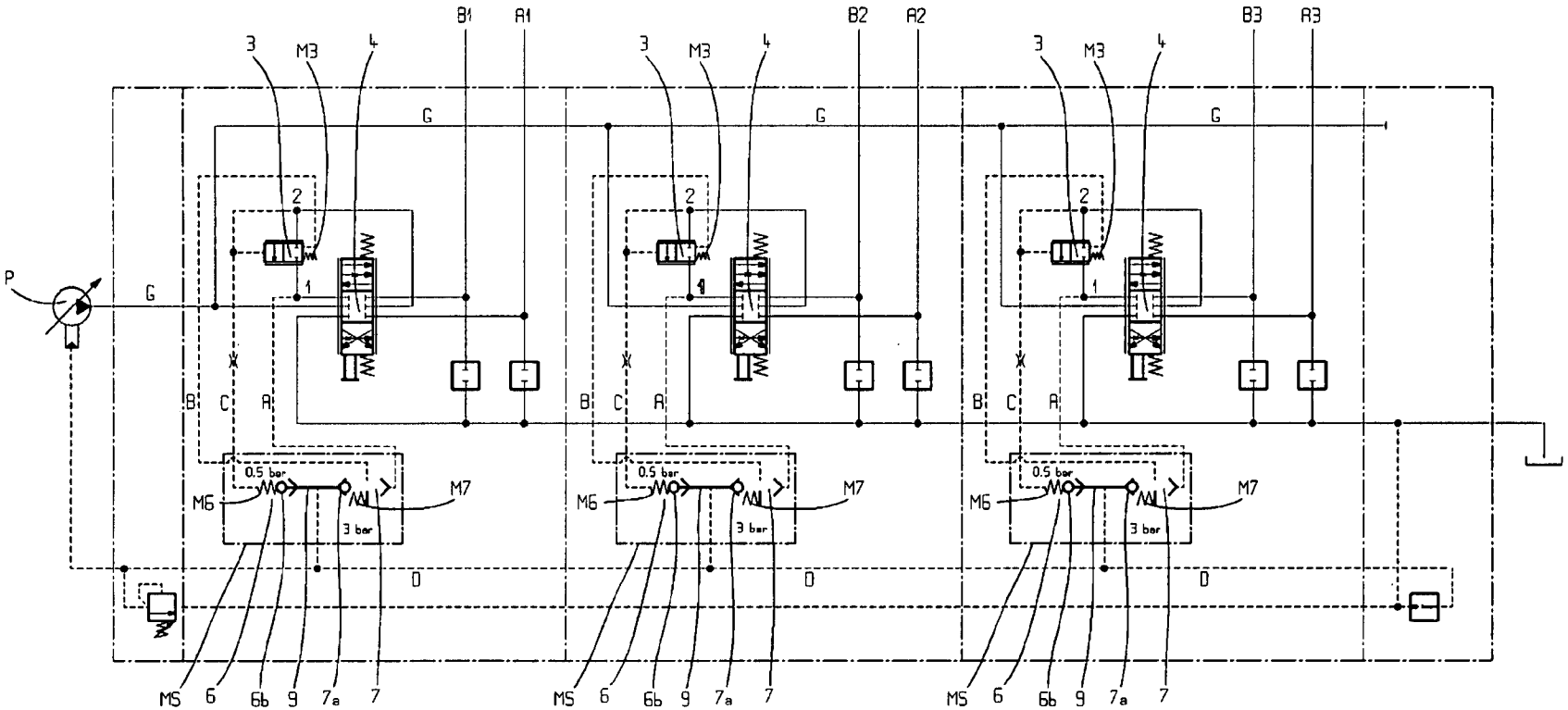
FIG. 2 shows a saturation-proof hydraulic control device that is composed of two or more elements with logic elements.

In order to reduce the described construction complexity, with reference to FIG. 2 it must be observed that, in place of the selector spool 5, logic circuits are inserted, in particular a selector valve 7 and a check valve 6 with spring M6. A spring M7 is added to the selector valve 7.

Spring M7 must generate a minimum load slightly greater than the pressure drop of the maximum flow-rate through the pressure compensator 3 of every element.

Balls 7*a* and 6*b* of the pressure selector means MS are mutually abutted with a mechanical transmission.

The mechanical transmission is a pusher 9 connected to ball 7*a* of selector valve 7 that, in several working conditions, maintains mechanically open the ball 6*b* of check valve 6.

Assuming that the pressure drop through the pressure compensator 3, with maximum allowable flow-rate from the hydraulic control device, is equal to two bars, it is enough to insert a spring M7 such as to guarantee a 3-bar force.

Assuming to actuate the element E1, the work function pressure from spot I towards A will operate on the ball 7*a* while the pressure from spot 2, through C, will operate on the ball 6*b*.

Taking into account a difference between the two pressures equal to a maximum of two bars, the balls will be arranged as included in the circuit in FIG. 2, due to the action of spring M7. Then the pressure 1 through B arrives to the spring M3 side of the pressure compensator 3 which operates as a check valve; while the pressure 2 between spool 4 and pressure compensator 3 arrives to the pump P and the other elements E2, E3 through D, being the ball 6*b* of check valve 6 open thanks to the mechanical action of pusher 9.

If it is assumed that E2 and E3 are actuated and with a work port pressure lower than E1, the LS pressure coming from the higher pressure element through D pushes the ball 7*a* of each element E2 E3 to close the channel A connecting D with B and then sending the signal to the spring M3 side of the pressure compensator 3 of each element. In such function, the same pressure of B, namely of D, is imposed in 2, namely in C. By analysing the ball 6*b* it is noted how it is subjected to the same pressure on both sides from which, thanks to the spring M6, it will close the passage between C and D.

When the pressure difference between two elements is lower than 3 bar, value of the added spring M7 that exceeds the maximum pressure drop of the maximum allowed work port flow through the pressure compensator 3 of each element, the balls 7*a* of both elements E2 and E3 remain placed as included in the diagram so that both compensators 3 perform the function of check valves and none of them the actual function of a pressure compensator.

Figure 3:
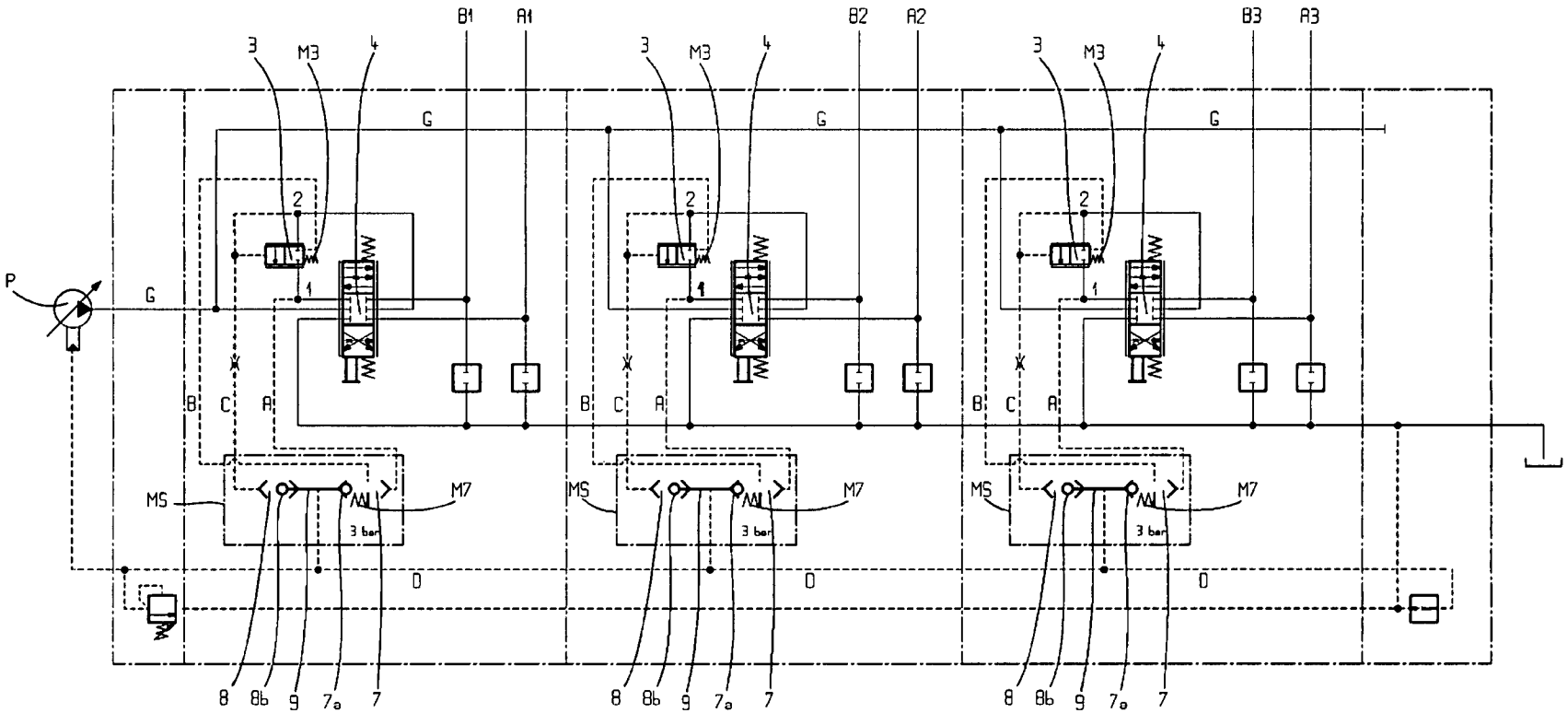
FIG. 3 shows a variation of the saturation-proof hydraulic control device that is composed of two or more elements with logic elements shown in FIG. 2.

In this situation, the balls 6*b* are kept physically open by the balls 7*a* with the cited mechanical transmission, so that the spots 2, namely the areas between spool 4 and pressure compensator 3, are mutually connected and there could be a minimum flow of oil from one element to the other, this being scarcely cumbersome given the minimum affected differential, that can however be removed by adopting the outline in FIG. 3.

With reference to FIG. 3, it is observed that the logic circuits are now two selector valves 7 and 8 with still the spring M7 being inserted, since it is essential, always such as to have a greater value than the pressure drop of the maximum allowed work port flow through the pressure compensator 3 of each element.

With such circuit, the problem of the minimum flow is removed, even when the pressure difference between two working elements is less than the spring M7 value, since, in place of the check valve 6, there is a selector valve 8, so that the ball 8*b* closes in its own seat, not allowing the connection between spots 2, namely the areas between spool 4 and pressure compensator 3.

Figure 4:
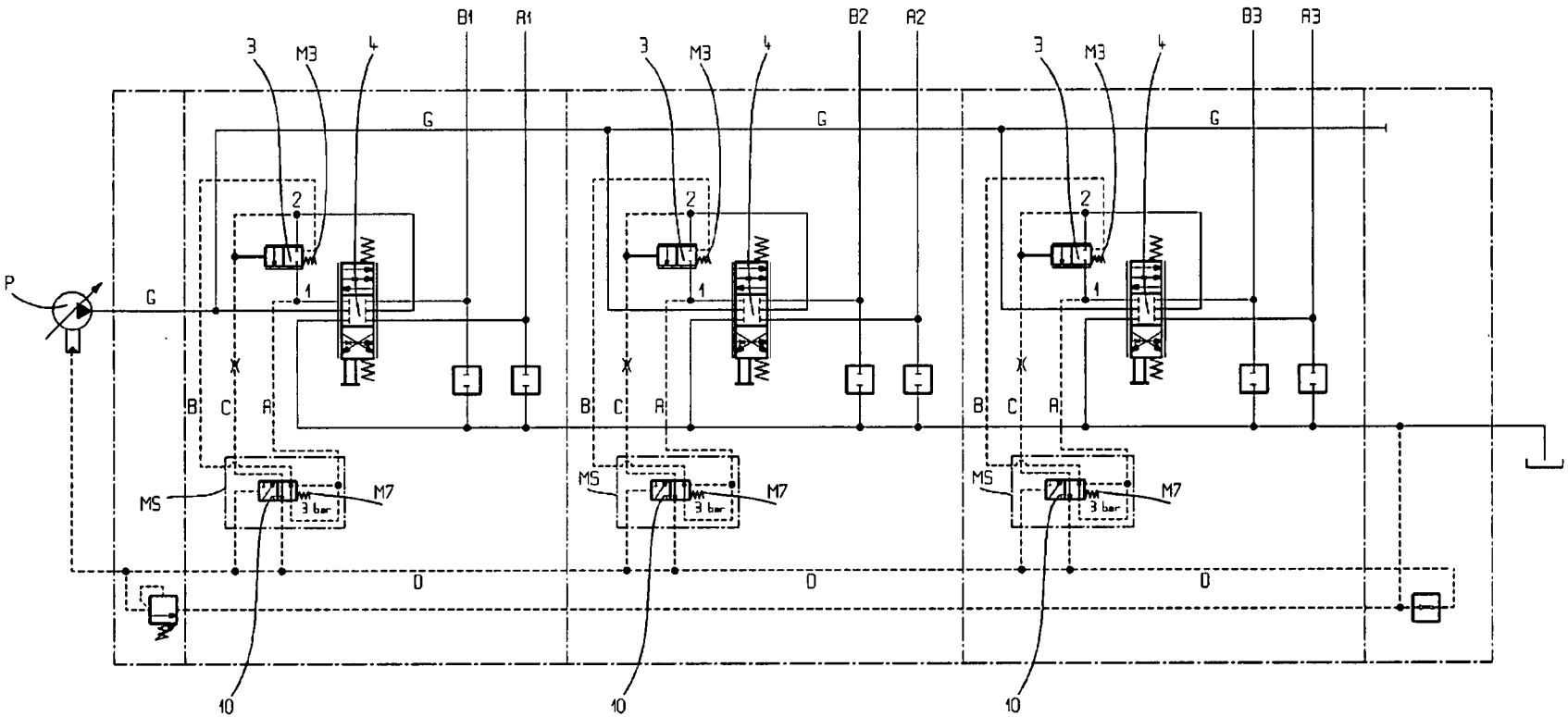
FIG. 4 shows a variation with spool of the saturation-proof hydraulic control device that is composed of two or more elements with logic elements shown in FIG. 2.
Figure 5:
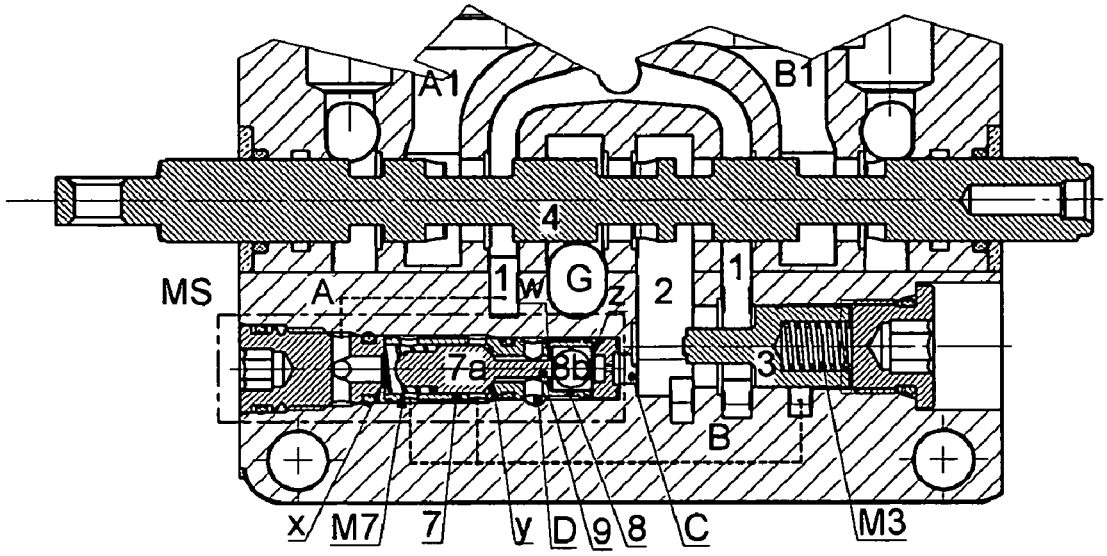
FIGS. 5 and 6 show a cross-sectional view of a constructive solution of the selection mean, respectively in pos. 1 and 2, of the saturation-proof hydraulic control device shown in FIG. 3.
Figure 6:
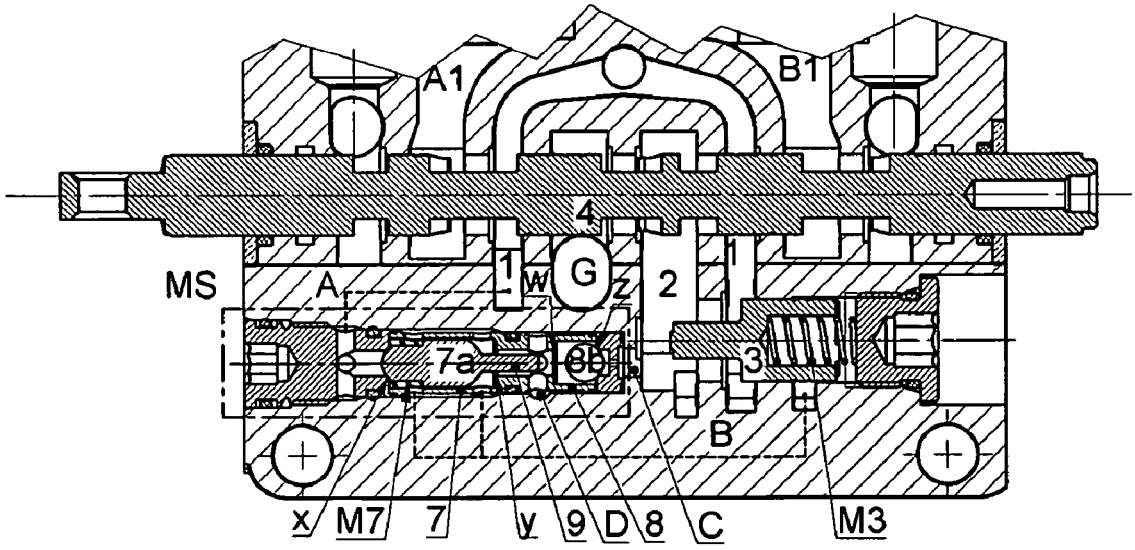

The constructive aspect of this circuit, as reported in FIGS. 5 and 6, is now analysed. The selection mean MS, represented in FIG. 4, is composed of a body with 4 seal seats of the same area (x, y, w, z) in which are inserted the selector 7*a* with the pusher 9, the ball 8*b* and the specifically designed spring M7. The selector 7*a* with pusher 9 is subjected on one side, through channel A, to the pressure in 1 between the pressure compensator 3 and the work port plus the action of the spring M7, on the other side to the pressure LS through channel D. The ball 8*b* is subjected on one side, through channel C, to the pressure in 2 between the spool 4 and the pressure compensator 3, on the other side to the LS pressure in D, already acting on the selector 7*a* with pusher 9, plus the possible mechanical action of the pusher 9 of the selector 7*a*. The selector 7*a* allows to connect through channel B the spring M3 side of the pressure compensator 3 to pressure 1 between the pressure compensator 3 and the work port or to the LS pressure in channel D.

Finally, the spring M7 is designed to generate, on the area of the 4 seal seats (x, y, w, z), a pressure slightly higher than the pressure drop caused by the maximum allowed work port flow through the pressure compensator 3. Namely slightly higher than the pressure drop that the maximum allowed work port flow generates between 2 and 1 in the element at higher pressure, where the pressure compensator 3 acts as a check valve; to simplify the explanation, the the maximum pressure drop will be assumed to be 2 bar and the spring M7 will exert an action equivalent to 3 bar. So this design of the spring M7 guarantees that the pressure 1 between the pressure compensator 3 and the work port plus the action of the spring M7 is always higher than the pressure 2 between the spool 4 and the pressure compensator 3 in the element with higher work port pressure.

Assuming to actuate the work element E1, the selector mean MS is arranged as in FIG. 5. The pressure in 1, through channel A, acts on the selector 7*a* with pusher 9, together with the spring M7, while the pressure in 2 acts through channel C on ball 8*b*.

The pressure 1 between the pressure compensator 3 and the work port plus the action of the spring M7 is higher than the pressure LS in D; also the pressure 2 between the spool 4 and the pressure compensator 3 is higher than the pressure LS in D. It follows that the selector 7*a* with pusher 9 and the ball 8*b* are abutted one against the other.

As previously explained, being the pressure in 1 plus the spring M7 higher than the pressure 2, the selector 7*a* seals on seat y, opening the passage through x and by means of the pusher 9 prevents ball 8*b* from sealing on seat w, while the equilibrium of pressures keeps passage through z open.

The following connections are established. The spring M3 side of the pressure compensator 3 is connected to the pressure 1 between the pressure compensator and the work port, so that the pressure compensator 3 acts as an actual check valve. The LS pressure in channel D is connected to the pressure 2, the last one not being reduced to the pressure in 1 between the pressure compensator 3 and the work port. This ensures the already stated advantages of a lower loss of the effective stand-by and of avoiding the problems of flow steps at the inversion of the higher load.

The selected LS pressure arrives through channel D to the selection means MS of the other elements and to the pump.

Actuating another element E2 at a lower work port pressure, its selection mean MS is arranged as represented in FIG. 6. In E2, the pressure LS in D generated by E1 is higher than both the pressure 1 plus the action of the spring M7 and the pressure 2 between the spool 4 and the pressure compensator 3. It follows that the selector 7*a* with pusher 9 is abutted against the seal seat x opening the passage through y, while the ball 8*b* is abutted against the seal seat z. Consequently the spring M3 side of the pressure compensator 3 is connected to the LS pressure in D, working as an actual pressure compensator.

Finally it must be underlined the function of the seal seat w, which allows to avoid a possible drawback due to the choice to use for the LS pressure the pressure in spot 2 between the spool 4 and the pressure compensator 3 instead of the pressure in spot 1, choice based on the already stated advantages.

Considering FIG. 6 which shows the element at low pressure, the equilibrium of the pressure compensator 3 is analysed. In theory it imposes in spot 2 the pressure LS (which is the pressure in spot 2 of the element at higher pressure). In practice, the flow forces must be added to the LS pressure, so the pressure in spot 2 tends to be slightly higher than the LS pressure. If now the selection mean in FIG. 6 is analysed, it appears that this difference of pressures tends to move the ball 8*b* from seat z. Since the selector 7*a* is pressed against seal seat x, the pressure in 2 could arrive, through channel B, to spring M3 side of its own pressure compensator 3, causing its closure if it were not for the ball 8*b* which, being pressed against the seal seat w, closes this connection preventing the phenomenon.

With reference to FIG. 4, a constructive variation is observed of the logic circuits outline shown in FIG. 2, in which said logic elements are replaced by a selector spool (10) of the on-off, four-way, two-position type, that guarantees at the same time all functional advantages of the previous case.

Also in this outline, the selector spool 10 is equipped with the already described spring M7.

Figure 7:
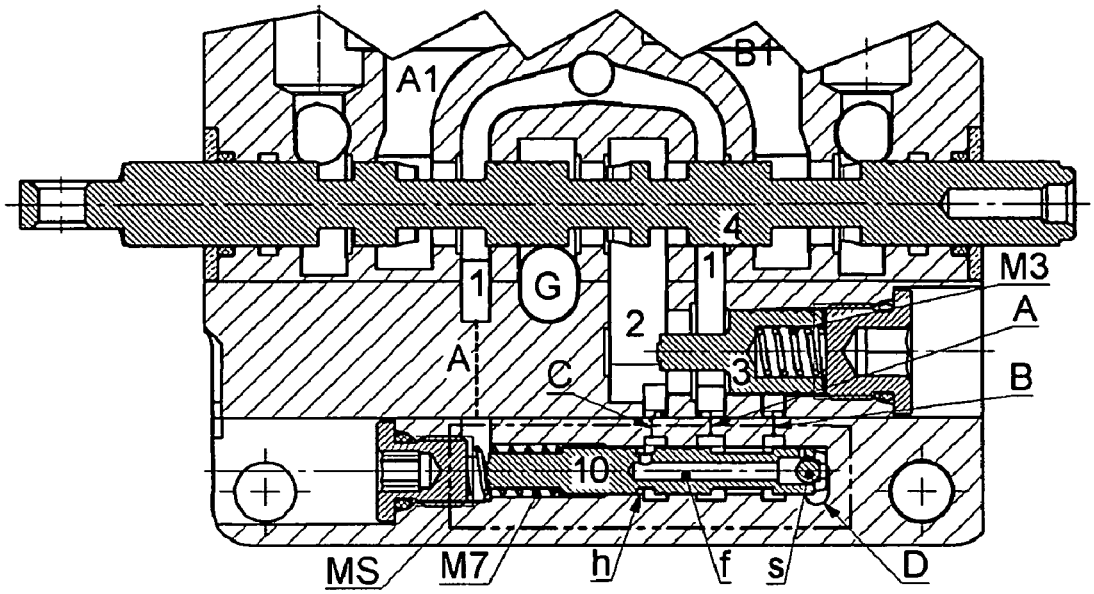
FIGS. 7 and 8 show a cross-sectional view of a constructive solution of the selection mean, respectively in pos. 1 and 2, of the saturation-proof hydraulic control device shown in FIG. 4.
Figure 8:
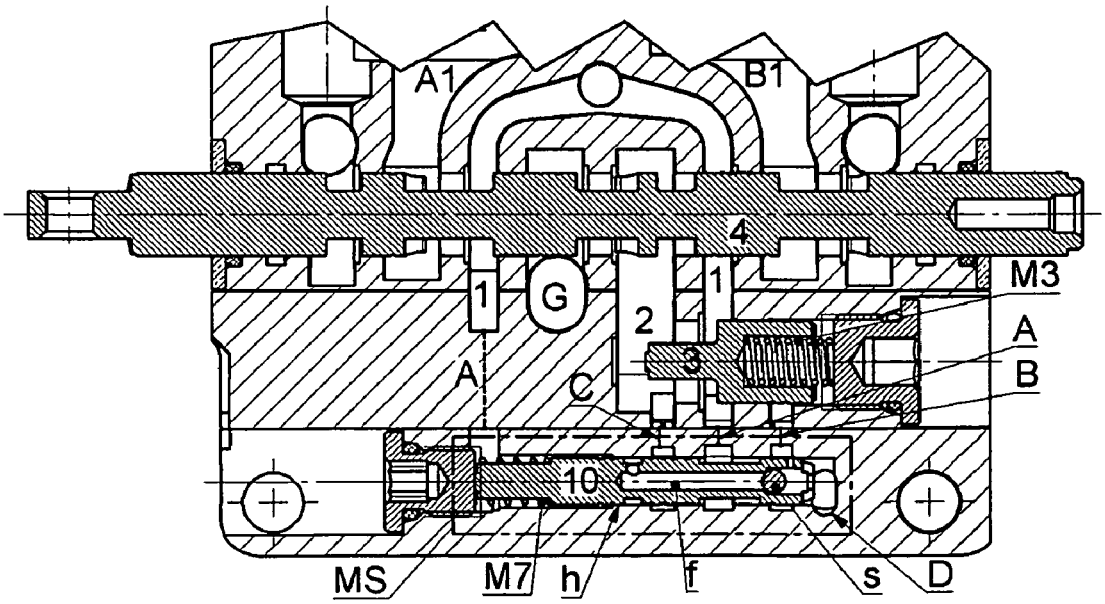

The constructive features shown in FIGS. 7 and 8 are now analysed. The selector spool 10 slides in a bore h, and is subjected on one side, through channel A, to the pressure 1 between the pressure compensator 3 and the work port plus the action of the spring M7, on the other side to the LS pressure through channel D.

The spring M7 is designed to generate, on the area of the section of the selector spool 10, a pressure slightly higher than the pressure drop caused by the maximum allowed work port flow through the pressure compensator 3. Namely slightly higher than the pressure drop which the maximum allowed work port flow generates between 2 and 1 in the element at higher pressure, where the pressure compensator 3 works as a check valve.

Such design allows the pressure 1 between the pressure compensator 3 and the work port plus the spring M7 to be always higher than the pressure 2 between the spool 4 and the pressure compensator 3 in the element at higher pressure.

The selector spool 10 allows to connect, alternatly and in an on-off way, the spring M3 side of the pressure compensator 3, through channel B, to the pressure in spot 1 between the pressure compensator 3 and the work port or to the LS pressure in D.

Assuming to actuate the element E1, the spool 10 will be arranged as in FIG. 7. The work port pressure in spot 1, through channel A, will act on one side of the spool 10 together with the spring M7, while the LS pressure will act on the opposite side of the spool.

The pressure in spot 1 between the pressure compensator 3 and the work port plus the spring M7 is higher than the LS pressure, hence the spool 10 is arranged as in FIG. 7. It stems the following connections: the chamber spring M3 side of the pressure compensator 3 is connected to the pressure 1 between the pressure compensator 3 and the work port, therefore the pressure compensator 3 works as an actual check valve. The LS pressure is connected to the pressure 2 between the spool 4 and the pressure compensator 3 through a hole f inside the spool, without being reduced to the pressure 1 between the pressure compensator 3 and the work port. This brings to the aforementioned advantages of a lower loss of the effective stand-by and of avoiding problems of flow steps at the inversion of the higher load.

The selected LS pressure arrives through channel D to the selection means MS of the other elements and to the pump.

If now it is assumed to actuate another element E2 at a lower work port pressure, the LS pressure generated by E1 is higher than the pressure 1 between the pressure compensator 3 and work port plus the spring M7. Hence the spool 10 of element E2 is arranged as in FIG. 8. It stems that the spring M3 side of the pressure compensator 3 is connected to the LS pressure, working as an actual pressure compensator.

Also in this case, if the difference between the pressures of the two actuated elements is lower than 3 bar, both the spools 10 are arranged as in FIG. 7 and so both the pressure compensators 3 work as check valves, with the same evaluations already stated for the previous solution.

Also in this case there is a connection through D between the two spots 2 with possible oil flow between the two elements. To avoid this, the ball s inserted in hole f, acting as a check valve, prevents the flow from channel D to spot 2.

The major concept on which saturation-proof is based is imposing the same pressure in the spots 2 between spool and pressure compensator. This is obtained by taking the highest work function pressure, and imposing it also in the elements with lower pressure due to pressure compensators (apart from the efficiency tolerances that could create differences of some bars).

If there were a machine that ensured always the same pressure on all elements, this would work already in saturation-proof conditions without the need of compensators, but only of check valves in order to avoid the backflow.

Now, when the pressure difference between the two work functions is lower than three bars, it can be stated that it falls within the previous case, so that there is no malfunction if both compensators operate as check valve.

The invention claimed is:

1. A saturation-proof hydraulic control device, comprising:

two or more elements, each element comprising a proportional six-way, threeposition spool (4), a proportional pressure compensator (3) with a spring side, notches on the spool (4), the notches operative for a correct operation, and a pressure selector means (MS) operatively connected to the spring side of the pressure compensator so that a higher-pressure work function sends a pressure to the spring side of the pressure compensator (3) for operation as a check valve, the pressure selector means comprising a selector valve (7) with a ball (7*a*), a check valve (6) with a ball (6*b*), a pusher (9) connected with the ball (7*a*) of the selector valve (7), and a spring (M7) acting on the ball (7*a*) of the selector valve (7), wherein, the ball (6*b*), in a working condition, is kept mechanically open by a mechanical transmission of the pusher (9) connected with ball (7*a*) of selector valve (7), with the spring (M7) acting on the ball (7*a*) of the selector valve (7), and with the spring (M7) generating a minimum load slightly greater than a pressure drop of a maximum flow-rate through the pressure compensator (3), so that the higher-pressure work function sends a pressure existing between the spool (4) and the pressure compensator (3) to the compensator (3) of another element and to a pump (P).

2. Saturation-proof hydraulic control device, comprising:

two or more elements, each element comprising a proportional six-way, threeposition spool (4), a proportional pressure compensator (3), notches on the spool (4), the notches operative for a correct operation, and a pressure selector means (MS) operatively connected to the spring side of the pressure compensator so that a higher-pressure work function sends a pressure to the spring side of the pressure compensator (3) for operation as check valve, the pressure selector means comprising first and second selector valves (7, 8) with respective balls (7*a*, 8*b*)

a pusher (9) connected with the ball (7*a*) of the first selector valve (7), a spring (M7) acting on the ball (7*a*) of the first selector valve (7), wherein, in a working condition, the ball (8*b*) of the second selector valve (8) is kept mechanically open by a mechanical transmission of the pusher (9) connected with the ball (7*a*) of the first selector valve (7), with the spring (M7) acting on the ball (7*a*) of the first selector valve (7), and with the spring (M7) generating a minimum load slightly greater than a pressure drop of a maximum flow-rate through the pressure compensator (3), so that the higher-pressure work function sends a pressure existing between the spool (4) and the pressure compensator (3) to the compensator (3) of another element and to a pump (P).

3. The saturation-proof hydraulic control device of claim 2, wherein, the pressure selector mean (7, 8) further comprises a body with four (4) seal seats of the same area (x, y, w, z) in which seats are inserted the ball (7*a*) of the first selector valve (7) with the pusher (9), the ball (8*b*) of the second selector valve (8) and the spring (M7), the ball (7*a*) of the first selector valve (7) with pusher (9) is subjected on one side to a pressure (1) between the pressure compensator (3) and a work port plus the action of the spring (M7), and on another side to another pressure (LS), the ball (8*b*) of the second selector valve (8) is subjected on one side to the pressure (2) between the spool (4) and the pressure compensator (3), and on another side to the another pressure (LS) plus any mechanical action of the pusher (9), the selector (7) connects the spring side of the pressure compensator (3) to pressure (1) between the pressure compensator (3) and the work port or to the another pressure (LS).

4. The saturation-proof hydraulic control device of claim 3, wherein, upon the pressure (1) between the pressure compensator (3) and the work port plus the action of the spring (M7) being higher than the another pressure (LS), and the pressure (2) between the spool (4) and the pressure compensator (3) is higher than the another pressure (LS)

i) the selector (7*a*) with the pusher (9) and the ball (8*b*) of the second selector valve (8) are abutted one against the other, ii) the selector (7*a*) of the first selector valve (7) seals on a first seat (y) of the seal seats, opening a passage through a second seat (x) and by means of the pusher (9) prevents the ball (8*b*) of the second selector valve (8) from sealing on a third seat (w), while equilibrium of pressures keeps passage through a fourth seat (z) open, iii) the spring side of the pressure compensator (3) is connected to the pressure (1) between the pressure compensator and the work port so that the pressure compensator (3) acts as an actual check valve, and iv) the another pressure (LS) is connected to the pressure (2) between the spool (4) and the pressure compensator (3), with the pressure (2) between the spool (4) and the pressure compensator (3) being greater than the pressure in (1) between the pressure compensator (3) and the work port.

5. The saturation-proof hydraulic control device of claim 3, wherein, upon the another pressure (LS) being higher than both the pressure (1) plus the action of the spring (M7) and the pressure (2) between the spool (4) and the pressure compensator (3)

i) the selector (7*a*) with the pusher (9) are abutted against the seal seat (x) opening the passage through (y), ii) the ball (8*b*) is abutted against a first seat (z) of the seal seats, and iii) the spring side of the pressure compensator (3) is connected to the another pressure (LS), working as an actual pressure compensator.

6. A saturation-proof hydraulic control device, comprising:

two or more elements, each element comprising a proportional six-way, three-position spool (4) with notches, a proportional pressure compensator (3) with a spring side, notches on the spool (4), the notches operative for a correct operation, and a pressure selector means (MS) operatively connected to the spring side of the pressure compensator so that a higher-pressure work function sends a pressure to the spring side of the pressure compensator (3) for operation as a check valve, the pressure selector means comprising an on-off, four-way, two-position selector spool (10), and a spring (M7) acting on the selector spool (10), wherein, the spring (M7) generates a minimum load slightly greater than a pressure drop of a maximum flow-rate through the pressure compensator (3) so that the higher-pressure work function sends the pressure (2) existing between spool (4) and the pressure compensator (3) to the compensator (3) of another element and to a pump (P).

7. The saturation proof hydraulic control device of claim 6, wherein, the selector spool (10) slides in a bore (h), and the selector spool (10) is subjected on one side to the pressure (1) between the pressure compensator (3) and a work port plus the action of the spring (M7), and on another side to another pressure (LS).

8. The saturation proof hydraulic control device of claim 7, wherein, upon the pressure (1) between the pressure compensator (3) and the work port plus the spring (M7) being higher than the another pressure (LS)

the spool (10) connects the spring (M3) side of the pressure compensator (3) to the pressure (1) between the pressure compensator (3) and the work port to operate the pressure compensator (3) as an actual check valve, the another pressure (LS) is connected to the pressure (2) between the spool (4) and the pressure compensator (3) through a hole (f) inside the spool, without being reduced to the pressure (1) between the pressure compensator (3) and the work port.

9. The saturation proof hydraulic control device of claim 6, wherein, the another pressure (LS) is higher than the pressure (1) between the pressure compensator (3) and work port plus the spring (M7), and the spool (10) connects the spring side of the pressure compensator (3) to the another pressure (LS) so that the pressure compensator (3) works as an actual pressure compensator.

* * * * *